US009873560B2

(12) United States Patent
Spahmann

(10) Patent No.: US 9,873,560 B2
(45) Date of Patent: Jan. 23, 2018

(54) AUTOMATICALLY UNLOCKING CONTAINER

(71) Applicant: Haul-All Equipment Ltd., Lethbridge, Alberta (CA)

(72) Inventor: Peter Spahmann, Lethbridge (CA)

(73) Assignee: Haul-All Equipment Ltd., Lethbridge, Alberta (CA)

( * ) Notice: Subject to any disclaimer, the term of this patent is extended or adjusted under 35 U.S.C. 154(b) by 16 days.

(21) Appl. No.: 14/801,478

(22) Filed: Jul. 16, 2015

(65) Prior Publication Data

US 2015/0321842 A1 Nov. 12, 2015

Related U.S. Application Data

(63) Continuation of application No. 13/929,285, filed on Jun. 27, 2013, now Pat. No. 9,114,931.

(51) Int. Cl.

| | |
|---|---|
| ***B65D 45/22*** | (2006.01) |
| ***B65F 1/16*** | (2006.01) |
| ***B65F 1/14*** | (2006.01) |
| ***B65F 1/02*** | (2006.01) |
| ***B65F 1/12*** | (2006.01) |
| *B65D 43/26* | (2006.01) |

(52) U.S. Cl.

CPC ..... *B65F 1/1615* (2013.01); *B65F 1/02* (2013.01); *B65F 1/122* (2013.01); *B65F 1/1452* (2013.01); *B65F 1/1623* (2013.01)

(58) Field of Classification Search

CPC ..... B65F 2003/0286; B65F 2003/0289; B65F 2003/0293; B65F 1/122; B65F 1/1452; B65F 1/1623

USPC ..... 220/326, 324, 908, 262

See application file for complete search history.

(56) References Cited

U.S. PATENT DOCUMENTS

| | | | | | |
|---|---|---|---|---|---|
| 2,488,429 | A | * | 11/1949 | Ochsner | B65F 3/043 414/407 |
| 2,951,602 | A | * | 9/1960 | Walden | B60P 1/50 414/411 |
| 3,011,666 | A | | 12/1961 | Dempster | |
| 3,662,910 | A | | 5/1972 | Herpich et al. | |
| 3,687,317 | A | | 8/1972 | Gagel | |
| 3,747,785 | A | | 7/1973 | Dahlin | |
| 4,088,071 | A | | 5/1978 | Cruse et al. | |
| 4,155,584 | A | * | 5/1979 | Pracchia | B65F 1/1615 294/68.1 |
| 4,239,437 | A | | 12/1980 | Naab | |
| 4,290,352 | A | * | 9/1981 | Schmidt | B30B 9/3046 100/100 |
| 4,363,588 | A | | 12/1982 | Stickney | |
| 4,456,141 | A | * | 6/1984 | Pamment | B65F 1/1607 220/254.3 |
| 4,811,660 | A | | 3/1989 | Robbins | |

(Continued)

*Primary Examiner* — J. Gregory Pickett
*Assistant Examiner* — Niki M Eloshway
(74) *Attorney, Agent, or Firm* — O'Shea Getz P.C.

(57) ABSTRACT

A container includes an enclosure housing an interior compartment for containing waste and further defining slots on sides of the enclosure for receiving lifting forks, a lockable rear lid pivotally connected to the enclosure, and an automatic unlocking mechanism actuated by lifting forks inserted into the slots for unlocking the rear lid to enable waste to be dumped from the container. The container may also be automatically re-locked when the forks are withdrawn from the slots.

14 Claims, 5 Drawing Sheets

(56) References Cited

U.S. PATENT DOCUMENTS

| | | | | | |
|---|---|---|---|---|---|
| 5,118,000 | A | | 6/1992 | Howell et al. | |
| 5,135,129 | A | | 8/1992 | Joly | |
| 5,897,014 | A | * | 4/1999 | English | B65F 1/1623 220/263 |
| 6,138,855 | A | * | 10/2000 | Kopf | B65F 1/1623 220/263 |
| 7,198,166 | B2 | | 4/2007 | Sholinder | |
| 2010/0181320 | A1 | * | 7/2010 | Laurin | B65F 1/004 220/524 |
| 2011/0266296 | A1 | | 11/2011 | Curotto | |

* cited by examiner

AUTOMATICALLY UNLOCKING CONTAINER

This application is a continuation of U.S. patent application Ser. No. 13/929,285 filed Jun. 27, 2013.

TECHNICAL FIELD

The present invention relates generally to garbage and recycling containers and, in particular, to front load containers or dumpsters adapted to be lifted and rotated to dump their contents into a waste collection vehicle.

BACKGROUND

A front load container is a garbage or recycling container that has slots or handles to be engaged by forklifts (or by forks or lifting arms of a waste-collecting vehicle) to lift and rotate the container so as to dump the contents of the container into the waste-collecting vehicle. A conventional front-load container has a lid that pivots open when the container is tipped. However, these conventional front-load containers are not locked and thus prone to being opened by animals such as bears. Lockable containers used in parks or other areas where bears live are inconvenient to operate as the garbage collector has to get out of the vehicle, unlock the container, return to the vehicle to dump its contents into the vehicle and then get out of the vehicle again to re-lock the container.

A need therefore exists for an improved container that overcomes this problem.

SUMMARY

In general, the present invention provides a front load container that is automatically unlocked when an unlocking mechanism in each of the slots on the sides of the container are engaged by forks or lifting arms of a waste collection vehicle. With the forks or arms inserted into the slots of the container, the container is lifted and rotated (i.e. tipped) to dump the contents into the waste collection vehicle. The container is then rotated and lowered back to the ground. The container is then automatically re-locked when the forks or lifting alms are retracted from the slots of the container, thereby disengaging the unlocking mechanisms in the slots.

Accordingly, one aspect of the present invention is a container having an enclosure housing an interior compartment for containing waste and further defining slots on sides of the enclosure for receiving lifting forks. The container includes a lockable rear lid pivotally connected to the enclosure. The container further includes an automatic unlocking mechanism actuated by lifting forks inserted into the slots for unlocking the rear lid to enable waste to be dumped from the container.

Another aspect of the present invention is a method of dumping waste from a container into a waste collection vehicle. The method entails inserting forks of the waste collection vehicle into slots on sides of the container, the forks engaging automatic unlocking mechanisms to automatically unlock a lockable rear lid pivotally connected to the enclosure. The method further entails lifting and rotating the container with the forks to dump the waste from the container into the waste collection vehicle.

Yet another aspect of the present invention is a waste container for a front-load waste collection vehicle. The container includes an enclosure defining an interior compartment for containing waste, fork-receiving channels on sides of the enclosure for receiving forks of the waste collection vehicle, a lockable rear lid pivotally connected to the enclosure, and an automatic unlocking mechanism that automatically unlocks the rear lid when the forks of the waste collection vehicle are inserted into the channels and engage the automatic unlocking mechanism.

The details and particulars of these aspects of the invention will now be described below, by way of example, with reference to the attached drawings.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION

Figure 1:
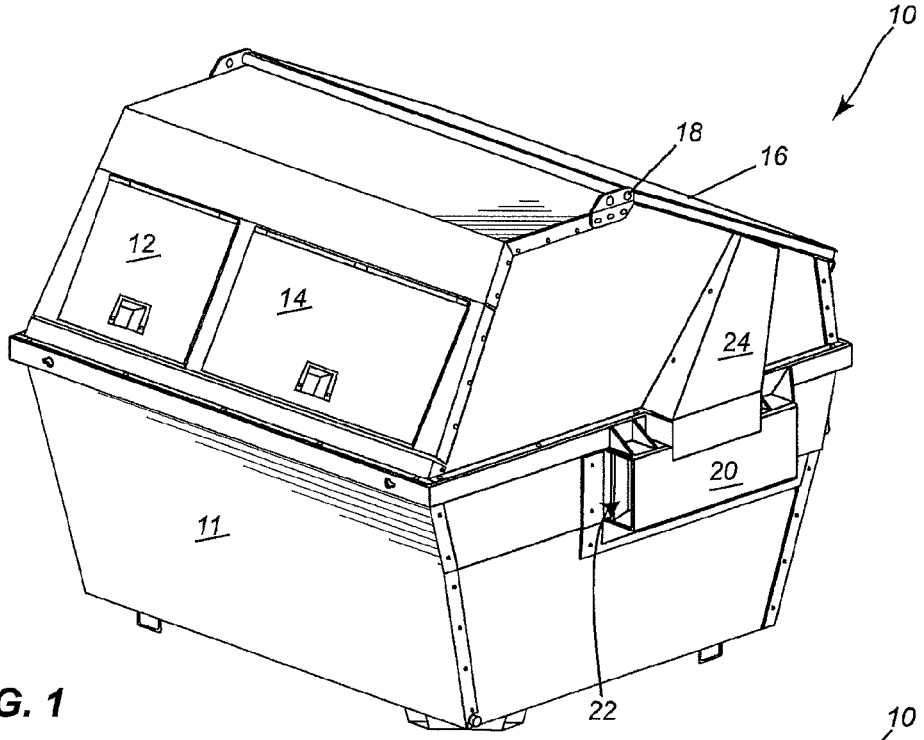
FIG. 1 is an isometric view of a container in accordance with an embodiment of the present invention.

A container, generally designated by reference numeral 10, is illustrated by way of example in FIG. 1. The container 10 has an enclosure 11 (or housing) formed by assembling, fastening or otherwise joining various sheets of metal or other suitable material. This enclosure defines one more interior or internal compartments for receiving and storing waste. In the illustrated embodiment, the container has two front hatches (or "top or side hinge load doors") 12, 14 for inserting waste into an internal compartment. These two front hatches 12, 14 are lockable so as to prevent a bear or other animal from open the hatches. The number, shape, size and placement of the hatches may be varied in other embodiments. Likewise, the shape of the container presented in the figures may be varied. As illustrated by way of example in FIG. 1, the container has a locked rear lid 16 for dumping garbage into a waste collection vehicle. The lid is pivotally mounted to a pivot 18. The rear lid is unlocked and re-locked using the unlocking mechanism described below.

In the container illustrated in FIG. 1, there is a slot-defining or channel-forming structure 20 defining a slot 22 or channel on each side of the container. In the illustrated embodiment, the slot-defining structures 20 and their respective slots 22 are substantially elongated and horizontal (i.e. parallel to the flat underside of the container) although the channel/slots may be oriented at other angles and may have a different shape from what is shown. Each of the two slots (or channels) is adapted (i.e. sized and shaped) to receive a fork or lifting arm of a waste-collection vehicle or of a forklift. Each of the two forks or lifting arms of the waste collection vehicle is inserted into a respective slot until an unlocking mechanism within each slot is engaged, causing the lid to be unlocked.

Figure 2:
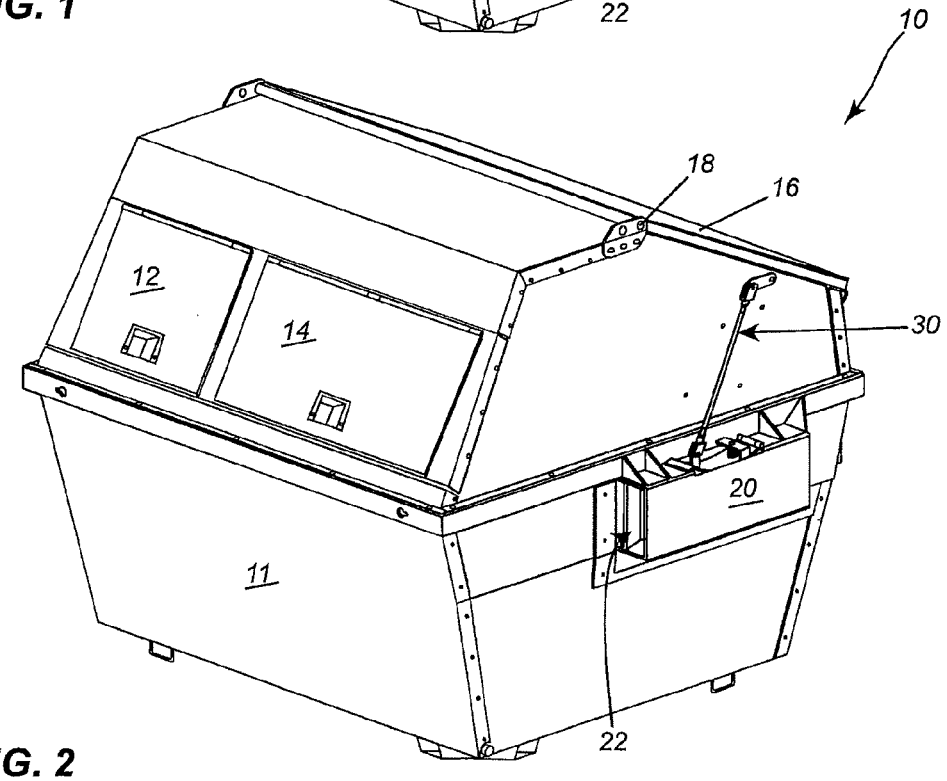
FIG. 2 is an isometric partial cutaway view of the container of FIG. 1 showing the side shroud removed to reveal the automatic unlocking mechanism.

The unlocking mechanism 30 is depicted in FIG. 2. This figure is identical to FIG. 1 except that the side shroud or cover 24 shown in FIG. 1 has been removed in FIG. 2. The side shroud/cover 24 depicted in FIG. 1 protects the unlocking mechanism. The automatic unlocking mechanism 30 is actuated by inserting lifting forks into the slots 22. The automatic unlocking mechanism unlocks and re-locks the lid 16. This obviates the need for the driver to alight from the vehicle, manually unlock the container, and then re-lock the container after dumping the waste.

Figure 3:
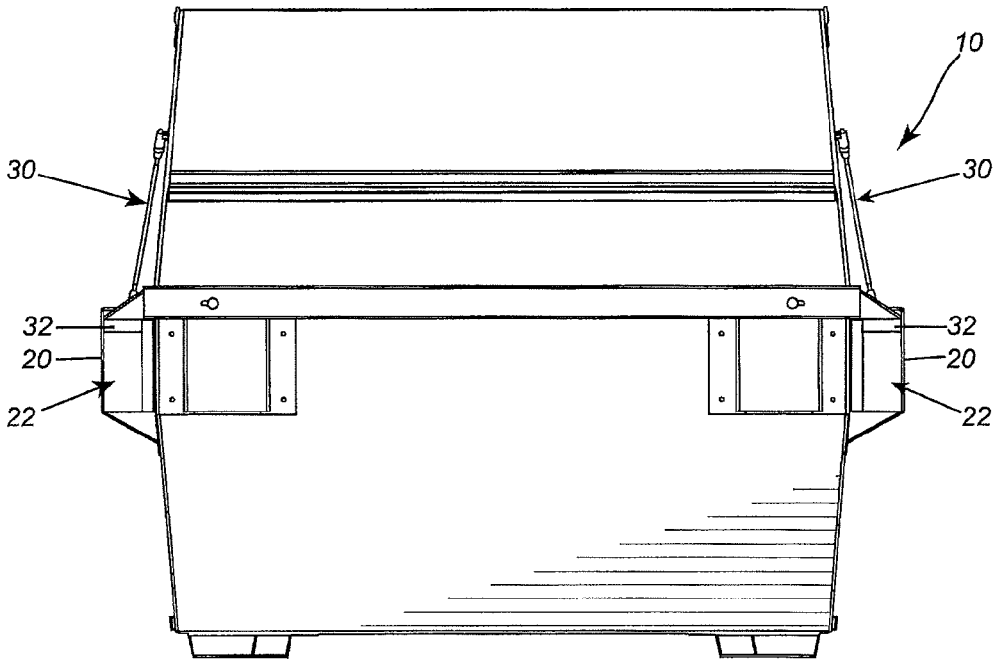
FIG. 3 is a rear view of the container of FIG. 2.

FIG. 3 is a rear view of the container of FIG. 2 (with the protective shroud removed to reveal the automatic unlocking mechanism 30. Also visible in FIG. 3 is a portion of the curved pivot plate 32 whose function in the automatic unlocking mechanism 30 will be described below.

Figure 4:
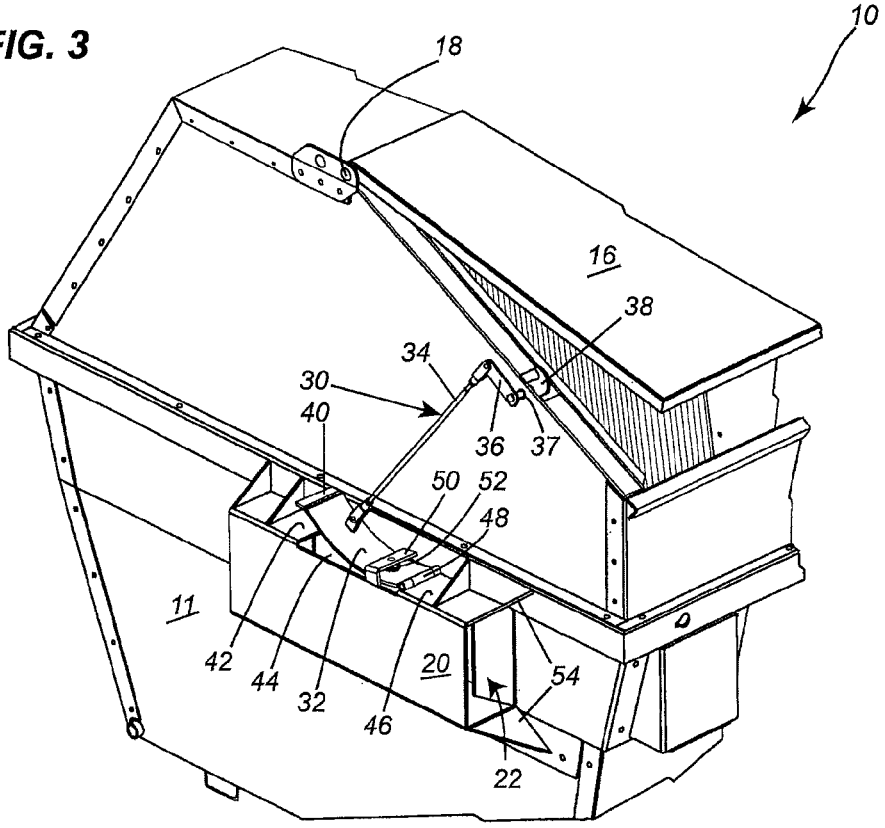
FIG. 4 is an enlarged isometric view of the open container and automatic unlocking mechanism.

FIG. 4 is an enlarged isometric view of the container 10 showing the automatic unlocking mechanism 30. The automatic unlocking mechanism 30 enables the lid 16 to be automatically unlocked simply by inserting the forks of a waste collection vehicle into the slots 22 or channels. In a main embodiment, the automatic unlocking mechanism 30 also automatically re-locks the lid 16 when the automatic unlocking mechanism 30 is disengaged (i.e. when the forks are withdrawn or retracted from the slots 22).

With reference to FIG. 4, the automatic unlocking mechanism 30 includes a curved pivot plate 32 that pivots upwardly when displaced by the fork (not shown). The automatic unlocking mechanism 30 also includes a main linkage arm 34 (e.g. rod) pivotally connected to the curved pivot plate. A pivot arm 36 is pivotally connected to the main linkage arm. A locking hook 38 is connected rigidly to the pivot arm. When actuated, the hook 38 disengages from an underside or locking member of the lid 16 to unlock the lid, thereby permitting it to pivot or open.

The forward end of the curved pivot plate includes a lip 40 for abutting an edge 42 of the substantially rectangular opening 44 in the top surface 46 of the channel or slot to stop the curved pivot plate from rotating lower than the closed position. The edge 42 thus acts as a stopper for the curved pivot plate by blocking further rotation of the lip 42. In the illustrated embodiment, the curved pivot plate 32 is pivotally mounted via pivot 48 to the channel/slot. The pivot may be a hinge, journal, bearing, or any other rotating means. Upward rotation is also stopped by an L-shaped stopper 50. Therefore, the automatic unlocking mechanism comprises both a first stopper 50 for limiting upward movement of the curved pivot plate 32 and a second stopper 42 for limiting downward movement of the pivot plate by blocking the lip 40. In the illustrated embodiment, a spring 52 is disposed between an upper surface of the curved pivot plate and the first stopper 50.

FIG. 4 also shows how the channels or slots 22 have a generally closed substantially rectangular form except for the top surface 46 which has a rectangular opening 44. This opening 44 enables the curved pivot plate 32 to rotate through a range of motion defined by the first and second stoppers.

As further illustrated by way of example in FIG. 4, the slots have flared plates 54. The flared plates are outwardly angled to deflect and guide the forks into the slots, thereby facilitating the insertion of the forks into the slots.

Figure 5:
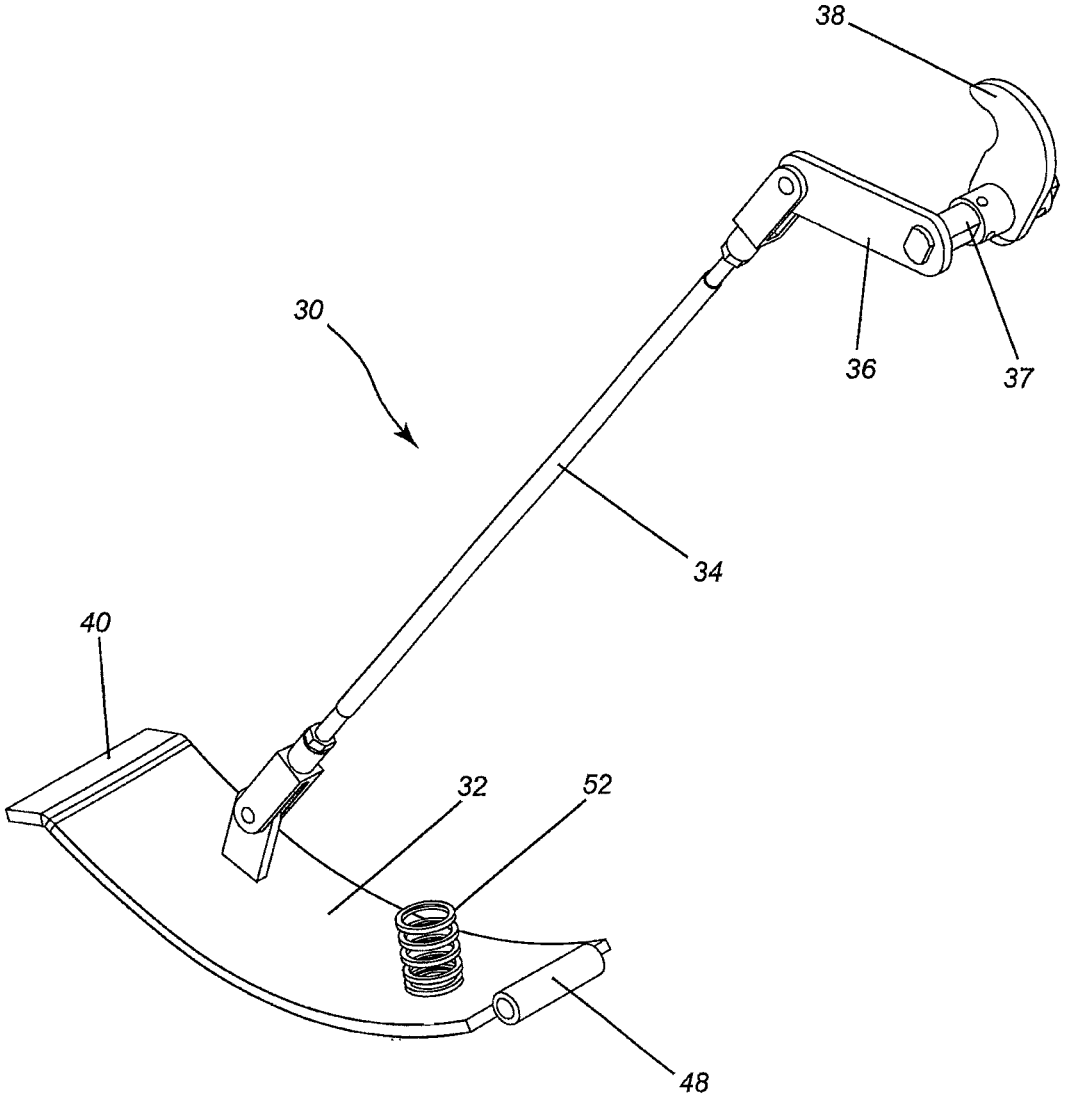
FIG. 5 is an isometric view of the automatic unlocking mechanism removed from the container.

Other details of the automatic unlocking mechanism are depicted in FIG. 5 which shows the mechanism 30 in isolation (i.e. removed from the rest of the container). As illustrated in FIG. 5, the automatic unlocking mechanism 30 includes the curved pivot plate (which may in one embodiment have a constant radius of curvature except for the lip 40). Pivotally attached to an upper surface of the curved pivot plate 32 is the main linkage 34 (rod) which is pivotally connected to the pivot arm 36. The pivot arm 36 is affixed to the hook 38. The arm 36 and hook rotate in unison about a pivot point 39 (see FIG. 6) framed by a hole in the side wall of the enclosure of the container. FIG. 5 shows the coil spring 52 which is mounted to the top surface of the curved pivot plate and which is compressed between the stopper (which in one embodiment is an L-shaped stopper 50) and the upper surface of the curved pivot plate 32 when the curved pivot plate is displaced by a fork and forced to rotate upwardly.

Figure 6:
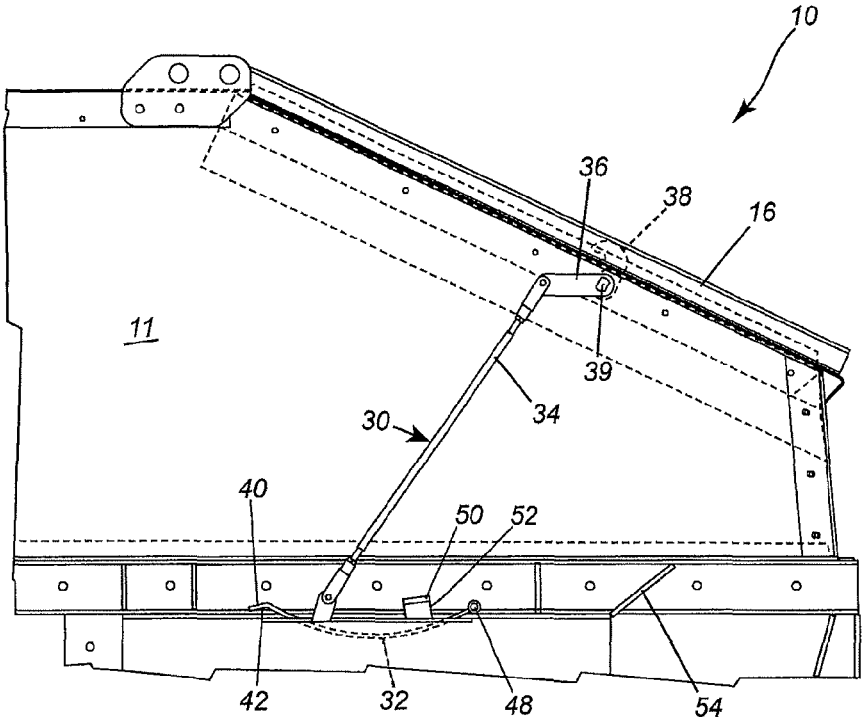
FIG. 6 is a side view of a portion of the container showing the lid closed and the automatic unlocking mechanism in a closed position.

FIG. 6 is a side view of a portion of the container 10 showing the lid 16 closed and the automatic unlocking mechanism 30 in a closed position. In the closed position, the lid 16 is locked and cannot be opened unless the two automatic unlocking mechanisms 30 are simultaneously actuated. This can only be done by inserting forks into the slots. Thus, the locked lid cannot be unlocked by a bear or other animal. In the closed position depicted in FIG. 6, the locking hook 38 engages a locking member like a bar on the underside of the lid. When locked, any effort to lift the lid will be opposed by the locking hook 38 and the rest of the mechanism 30.

Figure 7:
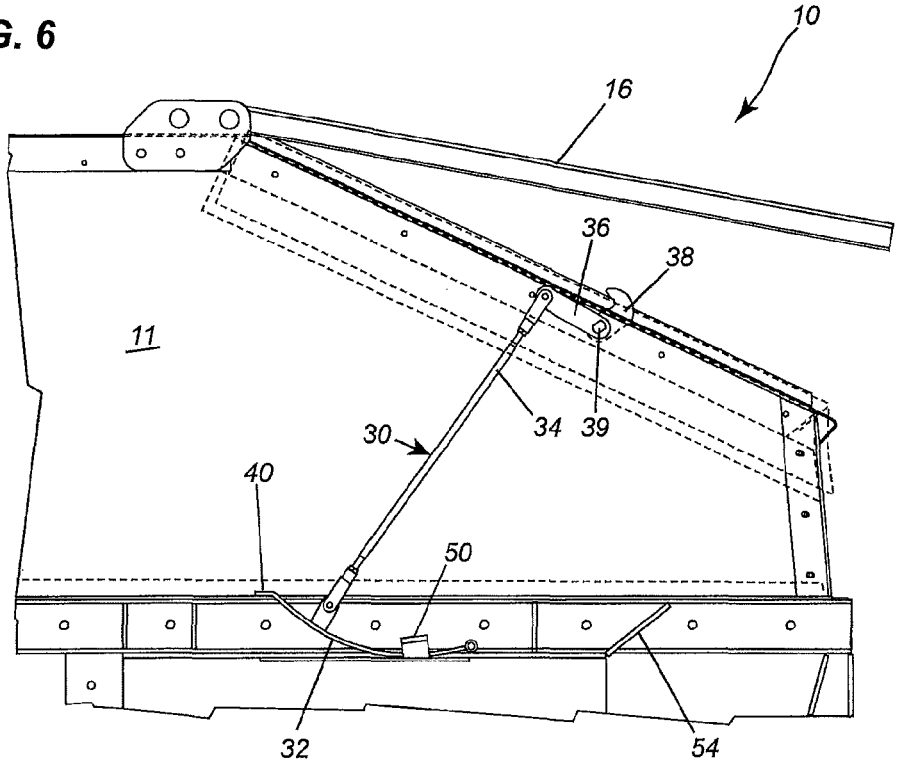
FIG. 7 is a side view of a portion of the container showing the lid open and the automatic unlocking mechanism in an open position.
Figure 8:
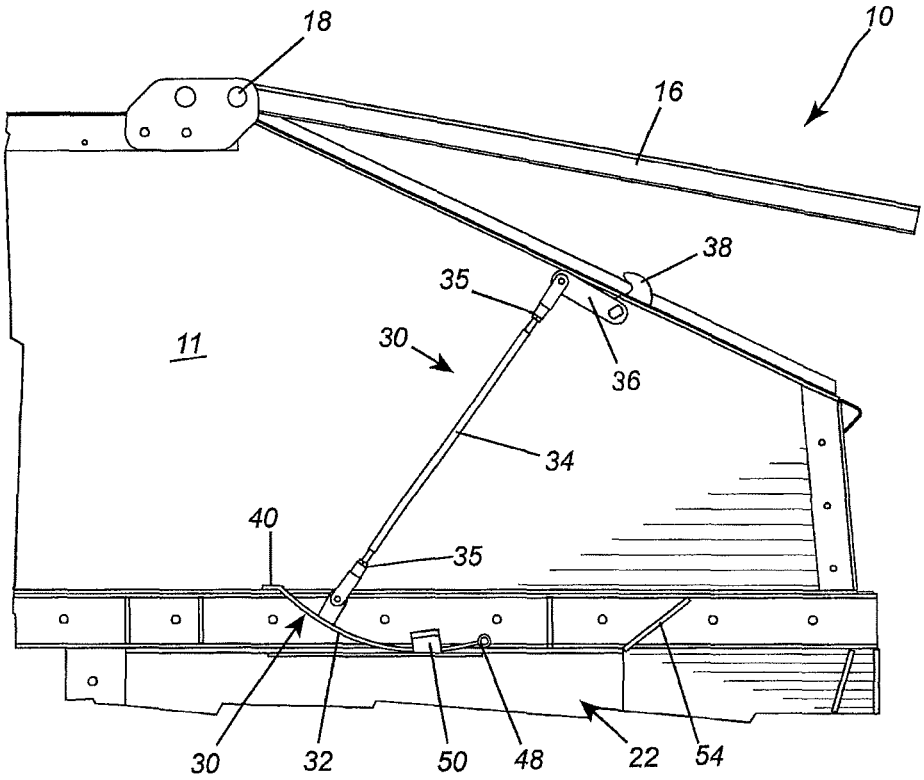
FIG. 8 is another side view of the open container.

FIGS. 7 and 8 show the lid 16 of the container 10 open and the automatic unlocking mechanism 30 in its open position. Specifically, FIG. 7 is a partial cutaway view whereas FIG. 8 is a side elevation view. In these two figures, the automatic unlocking mechanism 30 is pushed upwardly by a respective fork (not shown) inserted into the slot. As the fork is inserted into the slot, the fork displaces the curved pivot plate 32 upwardly, forcing the curved pivot plate 32 to rotate about the pivot axis 48. As the curved pivot plate 32 rotates upwardly, the main linkage arm 34 is pushed upwardly (relative to a plane defined by the rear opening covered by the lid 16). Pushing the main linkage arm 34 upwardly causes the pivot arm 36 and attached hook 38 to pivot about the pivot point 39 (i.e. the shaft 37 extending between the pivot arm 36 and the hook 38 rotates within a hole in the side wall of the enclosure). The rotation of the hook 38 unlocks the hook from the underside of the lid.

FIGS. 6 to 8 also show the functioning the stoppers. In the closed position of FIG. 6, the lip 40 abuts the edge 42. A portion of the curved pivot plate 32 extends into the slot as shown in FIG. 6. In the open position of FIGS. 7 to 8, the L-shaped stopper 50, which is affixed to the side of the slot, limits upward rotation of the curved pivot plate. The L-shaped stopper furthermore compresses a spring 52 to elastically bias the unlocking mechanism back to its closed position of FIG. 6. The spring tension of the spring is selected to permit the lid to be forced open by the forks when inserted into the slots, but to return to the closed position when the forks are withdrawn from the slots.

FIG. 8 furthermore illustrates that the automatic unlocking mechanism may include, as an optional feature, threaded linkage-length adjusters 35 to adjust the length of the main linkage arm 34 to thereby fine-tune the motion of the automatic unlocking mechanism.

This invention has been described in terms of specific examples, embodiments, implementations and configurations which are intended to be exemplary only. Persons of ordinary skill in the art will appreciate that obvious variations, modifications and refinements may be made without departing from the scope of the present invention. The scope of the exclusive right sought by the Applicant is therefore intended to be limited solely by the appended claims.

The invention claimed is:

1. A container comprising:

an enclosure housing an interior compartment for containing waste and further defining slots on sides of the enclosure for receiving lifting forks;

a lockable rear lid pivotally connected to the enclosure; and an automatic unlocking mechanism actuated by the lifting forks inserted into the slots for unlocking the rear lid to enable waste to be dumped from the container, wherein the automatic unlocking mechanism includes a locking hook entirely disposed beneath the lid and also internal to the container when the lid is closed, the hook being rotatable beneath the lid to disengage from an underside of the lid when the automatic unlocking mechanism is actuated, wherein the automatic unlocking mechanism includes for each slot:

a curved pivot plate that pivots upwardly when displaced by a respective fork;

a main linkage arm pivotally connected to the curved pivot plate; and a pivot arm pivotally connected to the main linkage arm;

wherein the locking hook is connected to the pivot arm, the hook disengaging from the underside of the lid to unlock the lid.

2. The container as claimed in claim 1 wherein the automatic unlocking mechanism relocks the lid when the forks are retracted from the slots.

3. The container as claimed in claim 1 further comprising a lockable access hatch on a front face for inserting waste into the container.

4. The container as claimed in claim 1, wherein the automatic unlocking mechanism comprises a first stopper for limiting upward movement of the curved pivot plate and a second stopper for limiting downward movement of the pivot plate.

5. The container as claimed in claim 4 further comprising a spring disposed between an upper surface of the curved pivot plate and the first stopper.

6. The container as claimed in claim 4 wherein the first stopper is an L-shaped stopper disposed at an angle relative to a top surface of the slot and wherein the second stopper is a lip for abutting an edge of a rectangular opening in the top surface of the slot.

7. The container as claimed in claim 1, wherein the slots are defined by substantially rectangular channels each having a top surface that includes a rectangular opening to permit the curved pivot plate to rotate upwardly.

8. The container as claimed in claim 7 further comprising guide plates extending from each slot to provide a flared mouth for guiding the forks into the slots.

9. A method of dumping waste from a container into a waste collection vehicle, the method comprising:

inserting forks of the waste collection vehicle into slots on sides of the container, the forks engaging automatic unlocking mechanisms to automatically unlock a lockable rear lid pivotally connected to the enclosure by rotating a locking hook entirely disposed beneath the lid and also internal to the container when the lid is closed to disengage the hook from an underside of the lid, wherein each automatic unlocking mechanism includes:

a curved pivot plate that pivots upwardly when displaced by a respective fork;

a main linkage arm pivotally connected to the curved pivot plate;

a pivot arm pivotally connected to the main linkage arm, wherein the locking hook is also connected to the pivot arm; and lifting and rotating the container with the forks to dump the waste from the container into the waste collection vehicle.

10. The method as claimed in claim 9 further comprising:

lowering the container to the ground using the forks of the waste collection vehicle; and retracting the forks from the slots of the container to disengage the automatic unlocking mechanism to thereby re-lock the container.

11. The method as claimed in claim 9, wherein engaging the automatic unlocking mechanisms further comprises causing each curved pivot plate to rotate against a spring disposed between an upper surface of the curved pivot plate and a stopper.

12. A waste container for a front-load waste collection vehicle, the container comprising:

an enclosure defining an interior compartment for containing waste;

fork-receiving channels on sides of the enclosure for receiving forks of the waste collection vehicle;

a lockable rear lid pivotally connected to the enclosure; and a pair of automatic unlocking mechanisms that automatically unlocks the rear lid when the forks of the waste collection vehicle are inserted into the channels and engage the automatic unlocking mechanisms, wherein the automatic unlocking mechanisms each include a locking hook rotatable beneath the lid to disengage from an underside of the lid when the automatic unlocking mechanism is actuated, wherein each automatic unlocking mechanism includes:

a curved pivot plate that pivots upwardly when pushed by a respective fork;

a main linkage arm pivotally connected to the curved pivot plate;

a pivot arm pivotally connected to the main linkage arm;

wherein the locking hook is connected to the pivot arm, the hook disengaging from the underside of the lid to unlock the lid.

13. The container as claimed in claim 12 wherein the automatic unlocking mechanism relocks the rear lid when the forks are retracted from the channels.

14. The container as claimed in claim 12 wherein the automatic unlocking mechanism comprises a first stopper for limiting upward movement of the curved pivot plate and a second stopper for limiting downward movement of the pivot plate, and wherein a spring is disposed between an upper surface of the curved pivot plate and the first stopper.

* * * * *